United States Patent [19]

MacEwen

[11] 4,373,646

[45] Feb. 15, 1983

[54] CARTRIDGE-TYPE DISPENSER

[75] Inventor: George E. MacEwen, Kansas City, Mo.

[73] Assignee: Phillips Petroleum Company, Bartlesville, Okla.

[21] Appl. No.: 263,654

[22] Filed: May 14, 1981

Related U.S. Application Data

[63] Continuation of Ser. No. 63,880, Aug. 3, 1970, abandoned.

[51] Int. Cl.[3] ..... B65D 85/72

[52] U.S. Cl. ..... 222/327; 222/386; 222/490; 206/384; 229/4.5; 229/5.5

[58] Field of Search ..... 222/326, 327, 386, 390, 222/391, 490, 563; 220/93, 229; 206/384; 229/5.5, 5.8, 3.1 R, 4.5; 53/486, 489, 471; 128/218 P

[56] References Cited

U.S. PATENT DOCUMENTS

| | | | |
|---|---|---|---|
| 1,188,526 | 6/1916 | Wright | 229/5.6 |
| 2,090,111 | 8/1937 | Creveling, Jr. . | |
| 2,193,517 | 3/1940 | Lindstrom . | |
| 3,274,747 | 9/1966 | Ineslein et al. . | |
| 3,884,396 | 5/1975 | Gordon et al. . | |
| 3,901,402 | 8/1975 | Ayres | 128/218 P |
| 4,117,971 | 10/1978 | Itoh . | |

FOREIGN PATENT DOCUMENTS

| | | | |
|---|---|---|---|
| 1212565 | 11/1970 | United Kingdom | 128/218 P |

*Primary Examiner*—H. Grant Skaggs

[57] ABSTRACT

A disposable container comprising a filled, temporarily sealed cartridge for use in a caulking gun-like apparatus for repeated discharge of incremental amounts of the contents thereof of mayonnaise-like consistency. The cartridge includes a generally cylindrical tubular body having an inwardly rolled rim at one end thereof with a generally circular disc disposed within the body and adhesively sealed in abutment with the rim. A plurality of mutually intersecting slits through the disc form a resilient, pressure-responsive valve and orifice in the center portion of the disc. A plug top closure is at least partially disposed in the open opposite end of the tubular body and is provided with a cylindrical sidewall sized to be closely received within the tubular body, at least one circumferential rib on the cylindrical sidewall for tightly and slidingly engaging the tubular body, and a radially outwardly extending closure flange for yieldably abuttingly engaging the annular end face of the tubular body. Alternate forms of generally circular discs as well as a method of assembling such a cartridge are also disclosed.

29 Claims, 13 Drawing Figures

CARTRIDGE-TYPE DISPENSER

This is a continuation of application Ser. No. 63,880, filed Aug. 3, 1970, now abandoned.

The present invention relates generally to improvements in containers. In one aspect the invention relates to improved container structure. In another aspect the invention relates to improved container construction technique.

Apparatus in use in one chain of fast service food outlets for dispensing one or more salad dressing-like food sauces comprises a trigger-actuated gun for discharging an accurately measured incremental quantity of such sauce on each single stroke of the gun trigger. The gun includes a reusable cylindrical container in which a piston works. A nozzle is attached to the container and comprises a fragile flat membrane of elastomeric material with crosshair cuts therein. The container, piston and nozzle of this apparatus must be disassembled and should be cleaned each time the container is emptied, and the container must then be refilled from a bulk supply. Economic as well as sanitary conditions make this procedure undesirable.

It has become quite customary in connection with devices generally referred to as caulking guns, put to their originally intended use, to supply caulking compound in disposable cartridges which remain sealed until placed in the gun. In some instances, the nozzle constitutes a permanent part of the gun and accordingly may have to be cleaned out after each use. In other instances, a nozzle comes with or is formed as a part of the disposable cartridge. In either event the nozzle usually is merely a tube having an inside diameter chosen to lay a bead of caulking compound having a predetermined diameter. Caulking compounds characteristically are heavy viscous materials which exhibit little, if any, tendency to exude from such nozzles in the absence of the considerable pressure which is exerted on the contents of the cartridge when extrusion of the compound is desired.

Mayonnaise, by definition, is a semisolid dressing made by emulsifying a mixture of raw eggs or egg yolks, vegetable oil and vinegar or lemon juice. With the addition of salt and condiments, it is used as a salad dressing or as a base for mixture with compatible materials to form salad dressings identified by various names. The consistency of mayonnaise, or mayonnaise-based salad dressings or dressings or sauces made in imitation thereof, is light and such products will extrude through a small orifice at very high velocity under very moderate pressure. Accordingly, when it is desired to extrude such material by means such as a caulking gun-type apparatus, a nozzle having an orifice of large effective diameter is required if excessive extrusion velocity is to be avoided. However, an orifice of appropriately large fixed cross-sectional area is impractical since the material usually will flow through such an orifice by gravity alone or by inertial forces incident to handling. It is for this reason that a flattened tube of elastomeric material has been used in the past to provide a nozzle which will expand and afford a large orifice only under discharge pressure.

In U.S. Pat. No. 3,884,396, a cartridge-type dispenser with resilient slitted outlet valve is disclosed for use with a caulking gun-type dispensing gun for the dispensing of sauces or the like of mayonnaise-like consistency. The cartridge-type dispenser disclosed in this patent comprises a cylindrical paperboard tube having a molded plastic dispensing head secured to the outlet end portion thereof by means of heat shrinkable tape. The dispensing head is provided with a male node which carries a frustoconically shaped nozzle therein, all of which is molded of a unitary mass of plastic material. The cartridge further includes a molded plastic plug closing the opposite end of the tubular body which plug is secured to the tubular body by means of heat shrinkable tape until immediately prior to insertion of the cartridge-type dispenser into the dispenser gun. The outlet of the male node is also closed by means of a suitable seal until it is desired to dispense the contents thereof by means of the dispensing gun. The construction of this cartridge-type dispenser is relatively expensive owing to the use of two molded plastic elements each requiring special mold tooling for the manufacture thereof and the excessively large number of manufacturing operations required to assemble, fill and seal the dispenser. The use of mold tooling for the manufacture of the dispensing head 20 also reduces the flexibility of the cartridge-type dispenser design of this patent to accommodate sauces or dressing of various consistency without complete redesign of the mold tooling. In a variation of the design of the cartridge-type dispenser of this patent, the molded plastic dispensing head has been modified to exclude the integral nozzle structure from the male node and accommodate in its place a removable nozzle insert constructed of a disc of flat plastic material having a plurality of mutually intersecting slits formed in the center thereof. This variation, however, adds an additional element to the dispenser structure and requires the additional manufacturing step of stamping or otherwise forming the nozzle insert from plastic sheet material as well as the additional assembly step of inserting each nozzle insert into the molded plastic dispensing head.

In U.S. Pat. No. 3,273,760, a cartridge-like container with expelling means for food products is disclosed wherein a flattened pliable dispensing nipple is provided for extruding the contents directly into the mouth of the consumer. This patent also shows, in certain modifications thereof, an extruding plunger which roughly nests with the head to minimize the amount of food product remaining in the package after a full stroke of the plunger. The dispensing nipple is not formed as an integral part of the cartridge and must be applied by the user after the cartridge has been opened.

U.S. Pat. No. 2,661,126 discloses a plunger-actuated dispensing container for viscous fluids such as printing ink. The orifice is relatively large but fixed in area whereby a removable closure must be removed and replaced incident to each use.

U.S. Pat. No. 3,682,356 discloses a mechanism for dispensing a fluid or pasty mass substance, including a piston device slidably mounted while a container which holds the substance. The container has a dispensing valve which is self-closing and which automatically opens when sufficient pressure is exerted upon the substance. The valve has an elastic conical element having a razor-like incision near the apex of the cone. When sufficient pressure is exerted on the substance, the incision opens to form a narrow slit through which the substance is dispensed. This patent does not, however, disclose a disposable cartridge-type dispensing package which performs the dual function of containing a food product from the time of packaging at a food processor's plant to the time of dispensing of the food product for ultimate consumption. Further, the container structure disclosed in this patent is not adapted for use with a trigger-operated dispensing gun.

U.S. Pat. No. 3,029,987 discloses a spout with a frangible diaphragm for use with a caulking cartridge. Various forms of frangible diaphragms disclosed in this patent are each formed of molded plastic requiring special mold tooling for each individual design with the attending expense and flexibility limitations attending the use of such tooling. U.S. Pat. Nos. 2,102,939; 2,111,582; 2,478,078; 3,130,872; 3,161,325; 3,288,333 and 3,319,841 are illustrative of cartridge-type caulking guns with nozzles of various types including some which are formed as a part of the gun and others which are formed as a part of the cartridge.

The prior art also includes many well known forms of cake or candy decorating devices which include nozzles for extruding paste material to form rosettes, gadroon edging and the like. A widely used nozzle for this purpose has a star-shaped orifice somewhat resembling the orifice disclosed in U.S. Pat. No. 3,884,396. However, such star-shaped nozzles are, so far as is known, made of rigid material wherein the size and shape of the orifices remains unchanged under varying amounts of extruding pressure since the purpose of the nozzle is to form an extrusion having a definite cross-sectional shape.

The present invention contemplates a container comprising a generally cylindrically shaped tubular sidewall having an inner surface and first and second open ends, the first open end being formed in a radially inwardly rolled lip, and the second open end having an annular end face. The container further includes a generally flat circular disc disposed within the tubular sidewall in abutting relation with the radially inwardly rolled lip, the circular disc having a plurality of slits therethrough and mutually intersecting at a point positioned generally in the center of the circular disc. The container also includes adhesive means disposed about the periphery of the circular disc and communicating between the circular disc and the tubular sidewall for securing the circular disc within the tubular sidewall in abutting relation with the inwardly rolled lip and providing a substantially fluid tight seal between the circular disc and the tubular sidewall. The container further includes plug top closure means at least partially disposed within the tubular sidewall at the second open end thereof, the plug top closure means having a generally cylindrical closure sidewall sized and shaped to be closely received within the second open end of the tubular sidewall, the closure sidewall having radially outwardly extending closure flange means on a first end portion thereof adapted for yieldably abuttingly engaging the annular end face of the second open end of the tubular sidewall. The closure sidewall further includes at least one radially outwardly extending circumferential rib means on the generally cylindrical outer surface thereof, sized and shaped to tightly slidingly engage the inner surface of the tubular sidewall so as to retain the plug top closure means within the tubular sidewall with the closure flange means in abutting engagement with the annular end face of the second open end of the tubular sidewall. The plug top closure means further includes generally radial end wall means extending across and closing a second end of the closure sidewall.

An object of the invention is to reduce the cost of cartridge-type fluid dispensers.

Another object of the invention is to provide a cartridge-type dispenser of simplified construction.

A further object of the invention is to reduce the number of parts in a cartridge-type dispenser.

A still further object of the invention is to reduce the operating steps in the construction of a cartridge-type dispenser.

Yet another object of the invention is to provide a cartridgetype dispenser which can be economically disposed of after a single use.

A yet further object of the invention is to provide a cartridge-type dispenser which is flat on both ends and reduces storage and shipping space required.

Other objects and advantages of the invention will be apparent from the following detailed description and claims when read in conjunction with the accompanying drawings in which:

Figure 1:
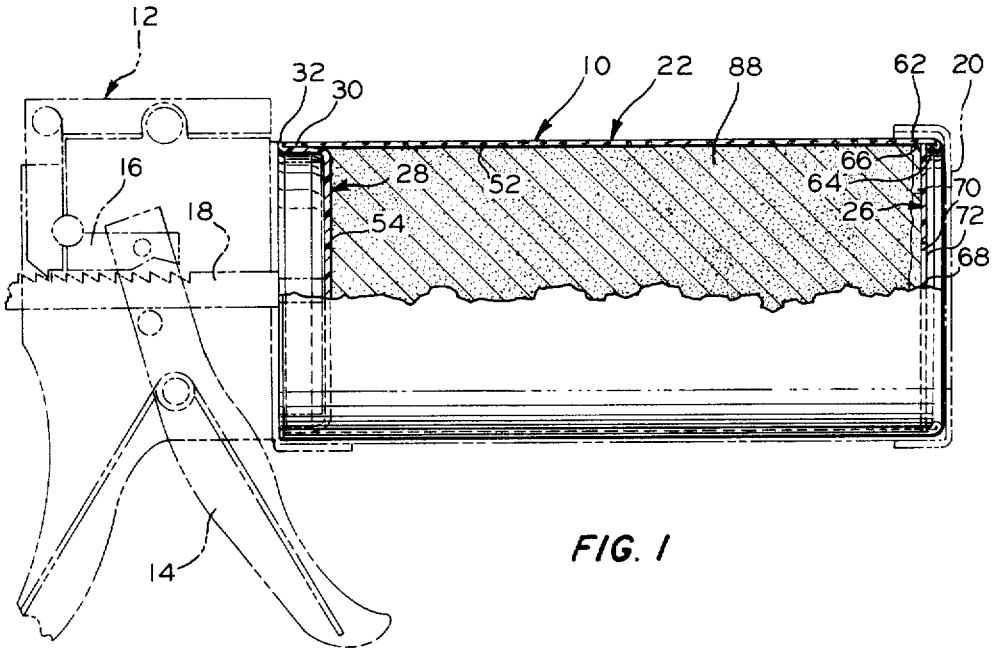
FIG. 1 is a side elevation view of a cartridge-type dispenser constructed in accordance with the present invention, with portions thereof shown in cross section, showing the cartridge-type dispenser filled with a dispensable product and positioned for use in a dispensing gun, the dispensing gun being illustrated in phantom lines.

Referring now to the drawings, and FIG. 1 in particular, a disposable cartridge-type dispensing package 10 constructed in accordance with the present invention is shown positioned in a dispensing gun 12, illustrated in phantom broken lines, the cartridge being filled and ready for immediate use. The gun 12 is preferably of the type which dispenses an accurately measured increment of the contents of the package or cartridge 10 upon each actuation thereo. To this end, the gun 12 can be provided with a trigger 14 and pawl and detent or other escapement means diagrammatically indicated at 16 adapted to cooperate with teeth on the piston rod of a plunger or follower generally indicated at 18, all as is well known in the art. At the forward end of the gun 12 a wall 20 is provided against which the forward end of the cartridge 10 rests so that pressure applied by the trigger mechanism of the gun 12 can be effective to dispense the contents of the cartridge as will be explained hereinafter.

The cartridge 10 comprises a generally cylindrically shaped tubular body or sidewall 22 preferably constructed of a polyethylenecoated, foil-laminated, food-grade paperboard. While any type of material can be employed in the construction of the tubular sidewall 22 which will provide the desired physical strength and food handling characteristics, it is presently preferred to employ a polyethylenecoated, foil-laminated, food-grade paperboard having a thickness of about 0.017 inch (0.43 mm) and having a conventional overlapped side seam 24, which seam is formed by applying sufficient heat and pressure to the overlapped portions of the sidewall to cause autogenous bonding of the superposed polyethylene-coated surfaces thereof. One such suitable paperboard is available from International Paper Company and is designated as 17 point solid bleached Kraft, foil laminated, polyethylene coated on both sides. The cartridge-type dispensing package or container 10 also comprises a dispensing head 26 and an extruding plug top closure or piston 28 designed to cooperate with the plunger or follower 18 of the dispensing gun 12.

The plug top closure 28 can be made of any suitable material, however, the closure 28 is preferably formed of a unitary homogeneous mass of plastic material such as a synthetic resin material. Examples of suitable synthetic resin material for use in constructing the plug top closure 28 include normally solid thermoplastic materials comprising at least one alpha olefin polymer. Examples of suitable alpha olefin polymers include high density polyethylene, low density polyethylene and polypropylene, with high density polyethylene being presently preferred.

The plug top closure 28 comprises a generally cylindrical closure sidewall 30 sized and shaped to be closely received within the generally cylindrical tubular sidewall 22. A radially outwardly extending closure flange 32 is formed on a first end portion 34 of the plug top closure and is characterized by a radial wall 36 abuttingly engageable with an annular end face 38 on one end of the tubular sidewall 22. The closure flange 32 is further characterized by an annular end face 40 formed thereon. The annular end face 40 communicates with the generally cylindrical inner surface 42 of the plug top closure 28 via a tapered annular surface 44 which diverges radially outwardly from the generally cylindrical inner surface 42 toward the annular end face 40. A pair of longitudinally spaced, radially outwardly extending circumferential ribs 46 and 48 are formed on the generally cylindrical outer surface 50 of the generally cylindrical closure sidewall 30 and are sized and shaped to tightly, frictionally engage the inner surface 52 of the tubular sidewall 22 to provide means for both retaining the plug top closure 28 within the tubular sidewall with the radial wall 36 in abutting engagement with the annular end face 38 of the tubular sidewall and wiping the inner surface 52 clean of the contents of the container 10 during the sliding operation of the plug top closure 28 relative to the tubular sidewall 22 in cooperation with the plunger 18 of the dispensing gun 12. The ribs 46 and 48 preferably each terminate at their radially outermost portion in a generally circumferential knife edge having an included angle of approximately 47°.

The plug top closure 28 further includes a generally radial end wall 54 closing the plug top closure at the second end portion 56 thereof opposite the closure flange 32. The generally radial end wall 54 communicates with the generally cylindrical closure sidewall 30 by means of a generally frustoconically shaped or tapered transition portion 58. The apical angle if the generally frustoconically shaped transition portion 58 is preferably approximately 40°. This frustoconically shaped or tapered transition portion 58 facilitates the insertion of the plug top closure 28 into the respective open end of the tubular sidewall 22 subsequent to the filling of the container 10 with the material to be dispensed therefrom . In this regard, the annular rib 48 is preferably interrupted at four circumferentially spaced locations 60 to provide means for venting air past the rib 48 during high speed insertion of plug top closures 28 into tubular sidewalls 22 by automatic packaging machinery.

The dispensing head 26 is preferably formed of a one-piece, generally flat circular disc disposed within the tubular sidewall 22 at the outlet end portion 62 thereof. The dispensing head 26 has a diameter slightly less than the inside diameter of the inner surface 52 of the tubular sidewall 22 so as to be closely received therein, and is positioned in abutting relation to a radially inwardly rolled lip 64 formed on the outlet end portion 62 of the tubular sidewall 22. The dispensing head 26 is fixedly secured in abutting relation with the lip 64 by means of a continuous circumferential bead or fillet of suitable adhesive communicating between the periphery of the dispensing head 26 and the inner surface 52 of the tubular sidewall 22 as shown at 66. The continuous circumferential fillet of adhesive 66 provides a fluid tight seal between the dispensing head 26 ad the tubular sidewall 22.

The dispensing head 26 can be formed of any suitable sheet material which will provide the desired closure of the outlet end portion 62 of the tubular sidewall 22. While any sheet material suitable for this purpose can be employed, it is presently preferred to utilize a sheet of synthetic resinous material. Examples of such suitable synthetic resinous material include normally solid thermoplastic materials such as those comprising at least one alpha olefin polymer, including high density polyethylene and low density polyethylene, with low density polyethylene being presently preferred. Suitable materials for the construction of the dispensing head 26 are characterized by inherent resiliency.

The dispensing head 26 is provided with a generally starshaped orifice 68 located in the central portion thereof. The orifice is composed of a plurality of slits 70 which mutually converge at the center of the dispensing head 26. The orifice 68 preferably comprises eight equally angularly spaced slits 70 which define a plurality of separate petal-like fingers or blades 72 which taper in width from the base of each blade to terminate in narrow pointed tips at the central point of the orifice 68. In a preferred embodiment, the thickness of the low density polyethylene sheet material forming the dispensing head 26 is approximately 0.030 inch (0.76 mm), and each slit is approximately 0.5 inch (1.27 cm) in length from the base of the adjacent blade 72 to the center of the orifice 68. The width of each slit 70 is preferably substantially zero when the fingers or blades 72 defining the orifice 68 are in their relaxed or closed position.

Figure 5:
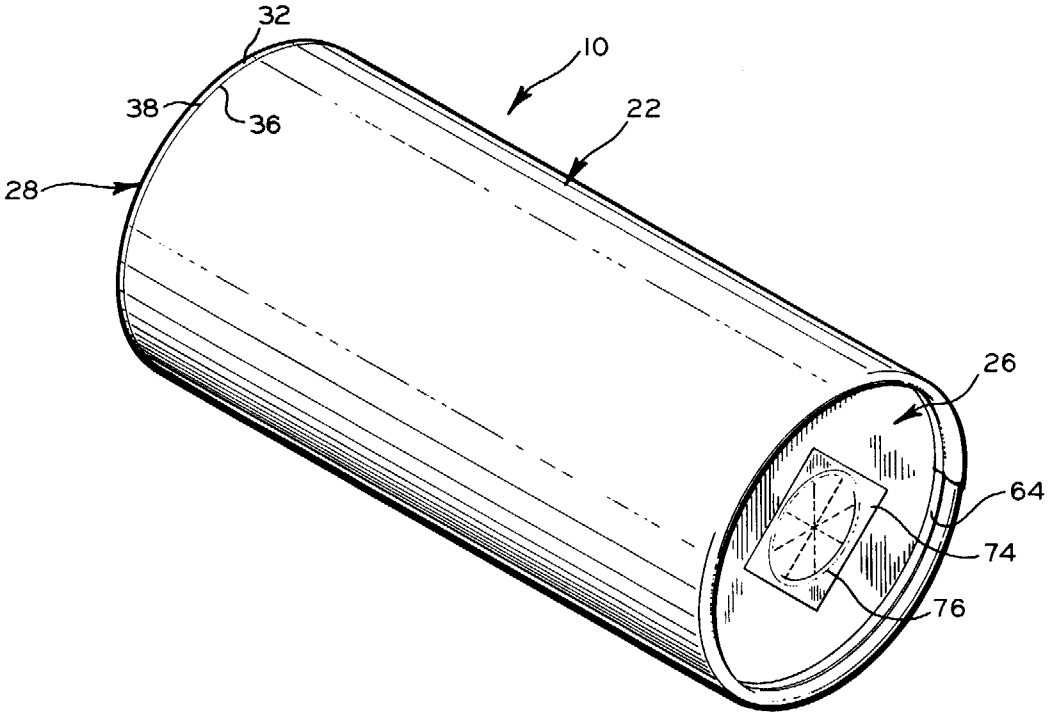
FIG. 5 is an isometric view of the cartridge-type dispenser of FIG. 3 fully assembled and closed.
Figure 6:
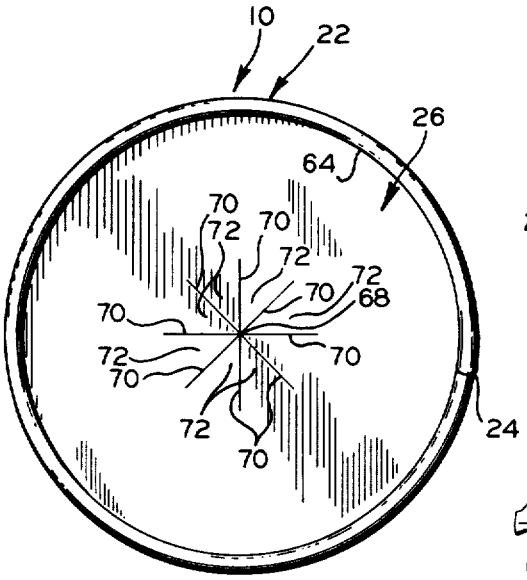
FIG. 6 is an end elevation view of the outlet end portion of the cartridge-type dispenser.
Figure 7:
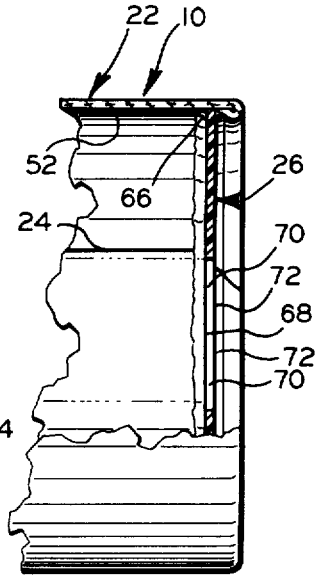
FIG. 7 is a partial side elevation view of the outlet end portion of the cartridge-type dispenser with portions thereof shown in cross section.
Figure 8:
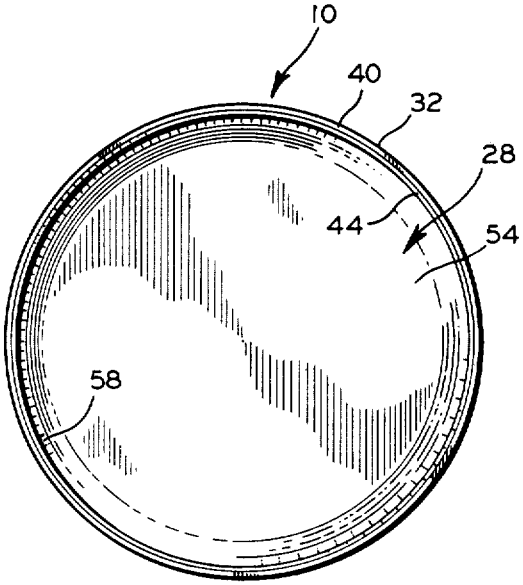
FIG. 8 is an end elevation view of the plug top end portion of the cartridge-type dispenser.
Figure 9:
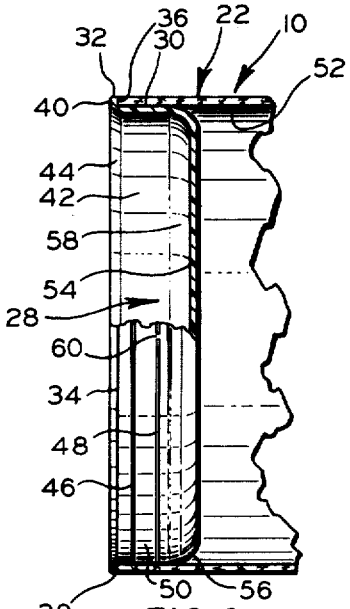
FIG. 9 is a partial side elevation view of the plug top end portion of the cartridge-type dispenser with portions thereof shown in cross section.

The orifice 68 of the dispensing head 26 is provided with a removable seal 74 which is adapted to be applied over the orifice 68 to prevent the passage of the contents of the container 10 through the orifice 68 until it is desired to begin dispensing the contents thereof through the action of the dispensing gun 12. The seal 74 can be of any suitable shape capable of covering the orifice 68 and is preferably provided with means thereon which can serve as a pull tab to facilitate the removal of the seal from the dispensing head 26. Preferably, the seal 74 is of a rectangular or square shape, whereby any one of the four corners can serve as a pull tab. The seal 74 can be made of plastic tape with adhesive applied to one surface thereof or, more preferably, a metal foil, such as aluminum, coated on one surface with a pressure or heat-sensitive adhesive. In either case the adhesive coated side of the seal 74 is pressed against the outer surface of the dispensing head 26 and is secured thereto by application of pressure or of heat and pressure as required. It is presently preferred to utilize the previously mentioned metal foil with a heat-sensitive adhesive on one surface thereof which is secured to the dispensing head 26 by means of heat and pressure applied to the seal 74 in the form of a heated ring of a diameter substantially greater than the diameter of the orifice 68, as shown at 76 in FIG. 5.

Figure 10:
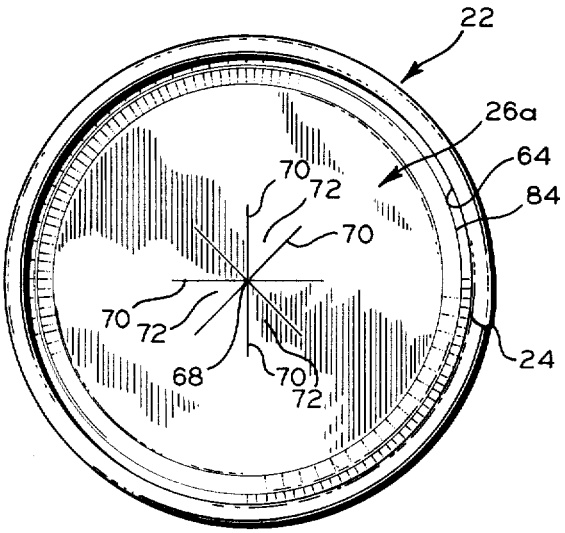
FIG. 10 is an end elevation view of the outlet end portion of an alternate form of cartridge-type dispenser constructed in accordance with the present invention.
Figure 11:
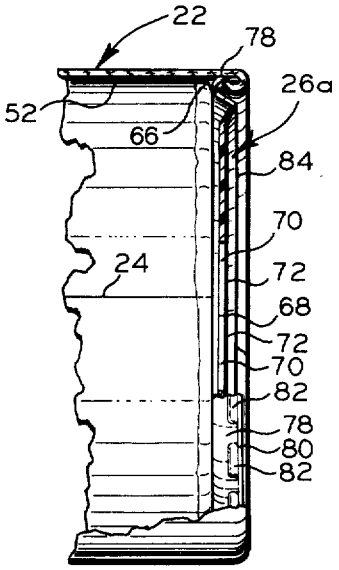
FIG. 11 is a partial side elevation view of the outlet end portion if the cartridge-type dispenser of FIG. 10 with portions thereof shown in cross section.
Figure 12:
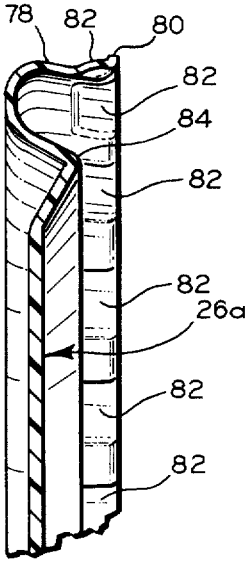
FIG. 12 is an enlarged partial cross-section view of the dispensing head of the cartridge-type dispenser of FIG. 10 more clearly illustrating the configuration of the skirt, flange portion and bosses.

Referring now to FIGS. 10 and 11, there is illustrated an alternate form of dispensing head which will be generally designed by the reference character **26*a*. The dispensing head 26*a* is also preferably formed of a single sheet of resilient material initially cut in the form of a generally circular disc. Suitable materials for use in constructing the dispensing head 26*a* include plastic materials such as synthetic resins, preferably normally solid, thermoplastic polymer materials. Suitable polymer materials include polyethylene, polypropylene, butadiene styrene copolymer and mixtures comprising any two or more thereof. A presently preferred material for constructing the dispensing head 26*a*** is low density polyethylene.

The dispensing head **26*a* is preferably formed under suitable temperature and pressure to a configuration comprising a circumferential skirt 78 terminating in a radially outwardly extending flange portion 80. A plurality of circumferentially spaced, radially outwardly extending bosses 82 are preferably formed in the dispensing head 26*a* extending between the flange portion 80 and the skirt 78. The bosses 82 provide both means for facilitating the stacking of a plurality of the dispensing heads 26*a* for the automatic production of the container of the present invention as well as facilitating the securement of the dispensing head 26*a* in the tubular sidewall 22 by means of a slightly modified radially inwardly rolled lip 64*a* which enfolds and engages the skirt 78 as illustrated in FIG. 10. The dispensing head 26*a* is further preferably provided with a generally circular rib 84 formed therein concentric with and adjacent the skirt 78. The dispensing head 26*a* is further preferably fixedly secured within the tubular body or sidewall 22 by means of a continuous bead or fillet of adhesive 66 which extends about the full circumferential line of contact between the dispensing head 26*a* and the inner surface 52 of the tubular sidewall 22. The dispensing head 26*a* is further provided with an orifice 68 in the center portion thereof identical to the orifice 68 previously described for the dispensing head 26**.

While any suitable thickness of material can be employed in the construction of the dispensing head **26*a* which will provide the desired valve action of the orifice 68 in conjuction with the dispensable contents carried by the container, it is presently preferred to employ low density polyethylene sheet material for the construction of the dispensing head 26*a*** having a thickness of about 0.030 inch (0.76 mm).

Figure 13:
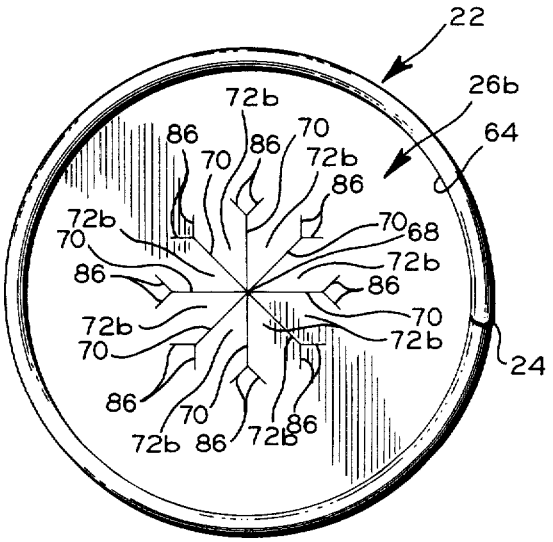
FIG. 13 is an end elevation view of the outlet end portion of another form of cartridge-type dispenser constructed in accodance with the present invention.

In FIG. 13 another slightly modified form of dispensing head **26*b* is illustrated. The dispensing head 26*b* is characterized by the addition of a pair of diverging slits 86 communicating with the radially outer end of each of the slits 70 of the slightly modified orifice 68*b*. Each pair of diverging slits 86 extends generally radially outwardly from the point of mutual intersection of the slits 70 and pass through the generally circular disc of sheet material forming the dispensing head 26*b*. The dispensing head 26*b* can be made of any of the materials suitable for construction of the dispensing head 26. The slightly modified orifice 68*b* defined by the fingers 72*b* provides valve structure which is somewhat less resistant to fluid flow therethrough than the orifice 68** if the dispensing heads are made of the same sheet material.

Figure 2:
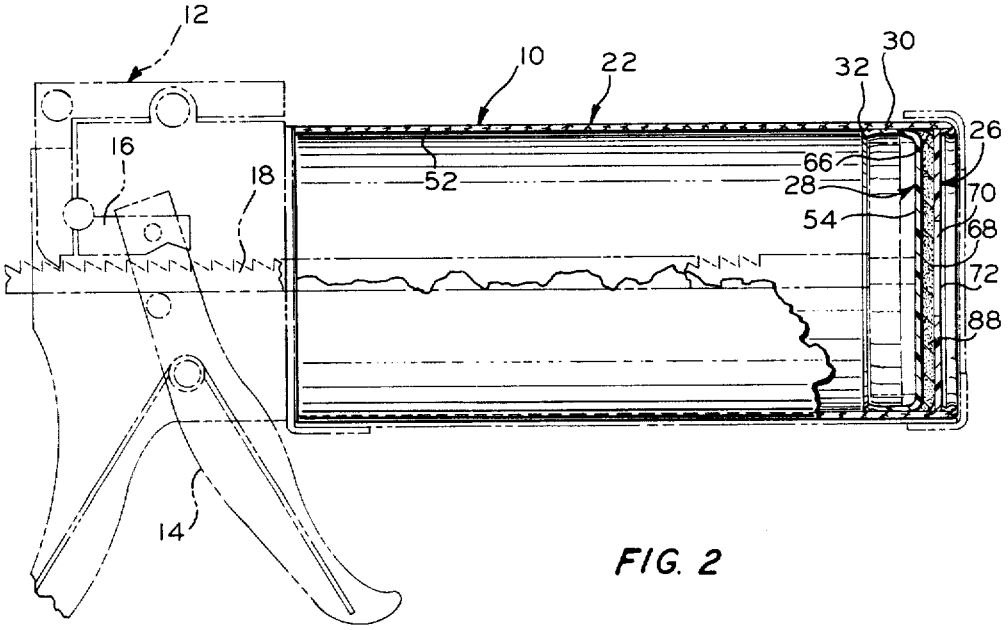
FIG. 2 is a side elevation view similar to FIG. 1 illustrating the cartridge-type dispenser in a condition assumed after a substantial portion of the dispensable product has been dispensed.
Figure 3:
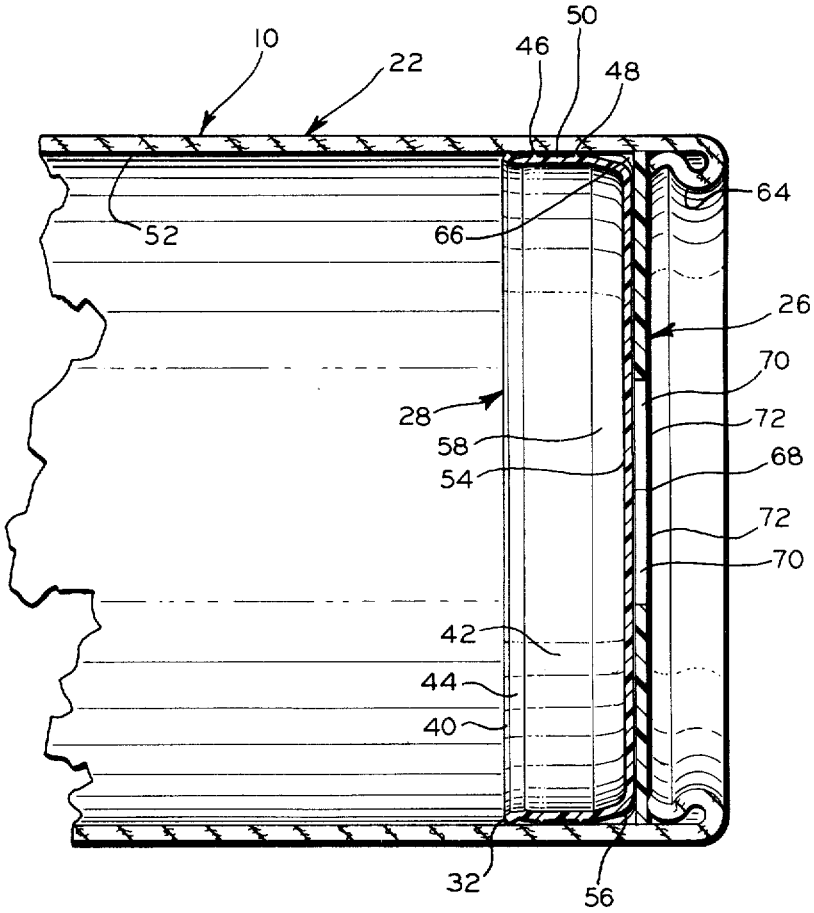
FIG. 3 is a partial enlarged side elevation view similar to FIG. 2 illustrating the cartridge in a condition assumed after substantially all of the dispensable product has been dispensed.
Figure 4:
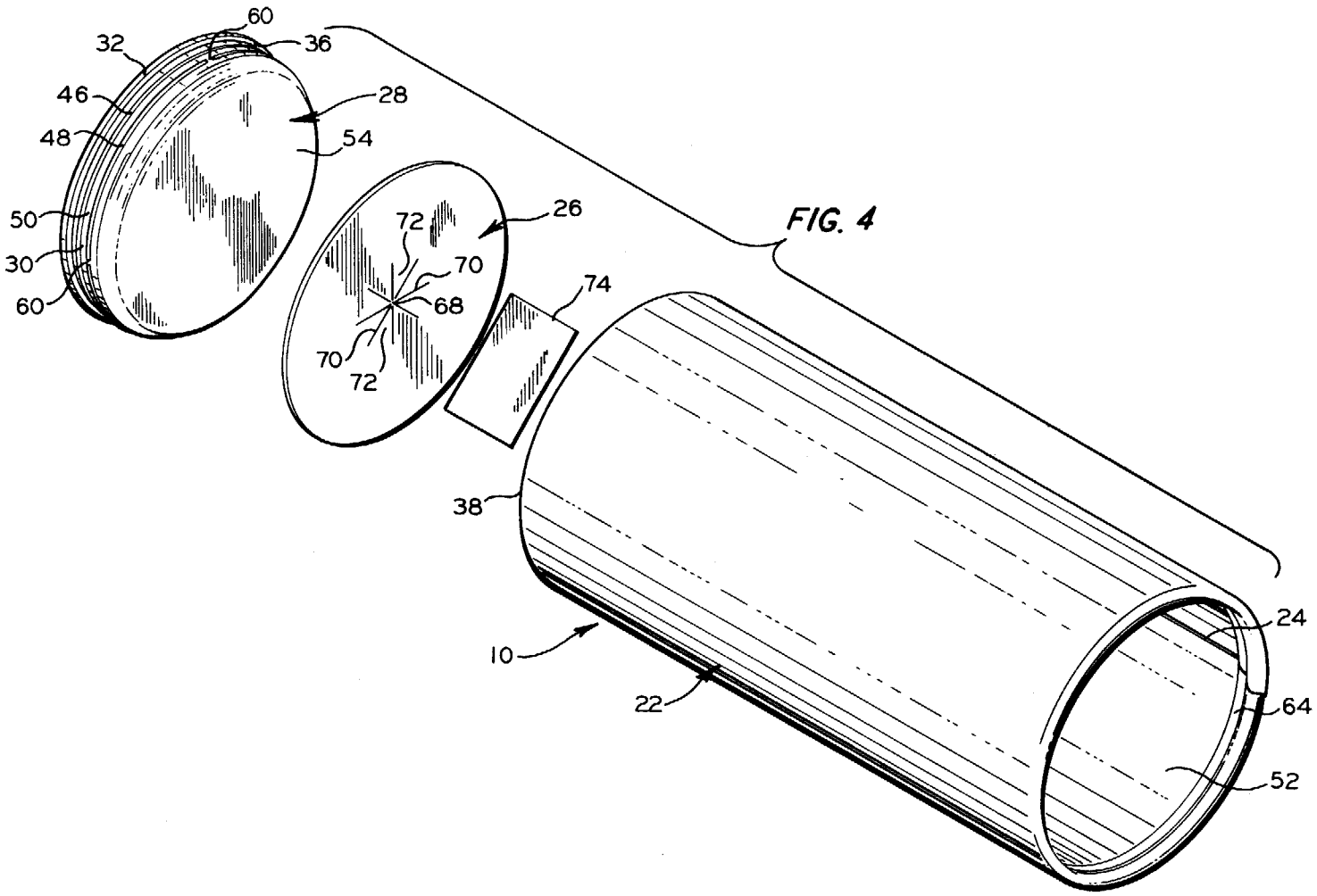
FIG. 4 is an exploded isometric view of an empty cartridge-type dispenser constructed in accordance with the present invention.

It is presently preferred to construct the plug top closure or piston 28 of molded high density polyethylene, as mentioned above, with the plug top closure having a nominal wall thickness of about 0.035 inch (0.89 mm). This preferred dimension, and the other preferred dimensions relating to the dispensing heads 26, **26*a* and 26*b* provide a cartridge-type dispensing package or container 10 which is well adapted for the dispensing of a dispensable product having the consistency of mayonnaise, ketchup or other similar products. On each stroke of the trigger 14, the dispensing head 26 or 26*a* will automatically assure that the desired quantity of such dispensable contents 88, as shown in FIGS. 1 and 2, will be dispensed at a low velocity irrespective of the manner in which the trigger 14 may be activated due to the resilient valve action of the fingers or blades 72 and 72*b* defining the orifice 68 or 68*b* in the dispensing head. Preferably each actuation of the trigger 14 is effective to extrude an accurately predetermined quantity of the dispensible contents of the container 10. For example, the trigger mechanism can be designed to extrude substantially exactly one third of a fluid once of the dispensable contents on each stroke of the trigger. When the contents 88 have been substantially completely dispensed, the parts of the package and dispensing gun assume the position shown in FIG. 3 wherein the plug top closure or piston 28 has moved into abutment with the inner surface of the dispensing head 26** and further movement of the plug top closure is prevented.

It should be noted at this point that upon the initial advancement of the plug top closure 28 through the tubular sidewall 22 from the position illustrated in FIG. 1, the radially outwardly extending closure flange 32 is forced radially inwardly by the increased abutting engagement force between the radial wall 36 thereof and the annular end face 38 of the tubular sidewall 22. Further movement of the plug top closure 28 through the tubular sidewall 22 causes the closure flange 32 to slidingly, sealingly engage the inner surface 52 of the sidewall 22 in response to the inherent resiliency of the material of which the plug top closure 28 is constructed which continuously biases the closure flange 32 radially outwardly into contact with the inner surface 52. The reduced cross-sectional area of the plug top closure 28 between the annular end face 38 and the tapered annular surface 44 facilitates the initial radially inward deformation of the closure flange 32 upon the initiation of movement of the plug top closure 28 through the sidewall 22.

The cartridge-type dispensing package or container 10 is well adapted for manufacture on the container manufacturing apparatus disclosed in U.S. Pat. No. 4,072,226, issued Feb. 7, 1978, and assigned to the assignee of record of the instant application.

Assembly of the container 10 can be achieved in the following manner. Each dispensing head 26, with a seal 74 secured thereto closing the orifice 68, is positioned by a suitable bottom feeder mechanism on the outer end of a respective mandrel which dispensing head is retained on the mandrel by means of vacuum applied to the mandrel. The dispensing head is positioned on the mandrel with the seal on the side of the dispensing head remote from the mandrel. The mandrel securing the respective dispensing head is then moved or indexed to a position adjacent a suitable sidewall feeder at which point a respective flat generally rectangular sidewall blank, having first and second parallel side edge portions and first and second end faces, is first heated along its first and second parallel side edge portions which will ultimately be overlapped, and is then positioned adjacent to and clamped on the cylindrical outer surface of the mandrel carrying the dispensing head. The mandrel carrying the dispensing head and sidewall blank is then moved or indexed to a position adjacent a suitable sidewall wrapper mechanism at which time the sidewall blank is wrapped about the cylindrical outer surface of the mandrel and the previously heated parallel side edge portions are overlapped and clamped together and allowed to cool, thereby forming the overlapped side seam 24 when the superposed heated thermoplastic coated layers become autogenously bonded together to form the tubular body or sidewall 22.

The mandrel carrying the thus formed tubular sidewall 22 and dispensing head 26 is then moved or indexed to a position adjacent a suitable bond heater where the thermoplastic coating of the tubular sidewall at the end thereof adjacent the dispensing head can be optionally heated to a suitable bonding temperature of the thermoplastic coating. If desired, this heating step can be omitted although the mandrel will still be indexed to and from this position in the operation of the conventional container manufacturing apparatus described in U.S. Pat. No. 4,072,226. The mandrel carrying the tubular sidewall and dispensing head is then moved or indexed to a position adjacent a rotating bottom sealing head which moves in coaxial alignment with the tubular sidewall into engagement with the either heated or unheated continuous edge of the tubular sidewall adjacent the dispensing head, and rolls the continuous edge inwardly, thereby forming a radially inwardly rolled lip 64 which abuttingly engages the outer periphery of the respective dispensing head.

It should be noted at this point that the alternate form of dispensing head **26*a* can also be employed with the container manufacturing apparatus disclosed in U.S. Pat. No. 4,072,226 in substantially the same manner as the dispensing head 26. When the dispensing head 26*a* is employed, the skirt 78 thereof extends outwardly from the outer end of the respective mandrel to which it is secured by vacuum means, and the radially inwardly rolled lip formed along the continuous edge of the tubular sidewall enfolds the skirt 78 of the dispensing head 26*a*** and the rolled sidewall lip and skirt are brought into intimate contact.

After formation of the rolled lip, the rotating bottom sealing head is then withdrawn from the thus formed rolled lip and the mandrel carrying the partially assembled container comprising a tubular sidewall 22 and dispensing head 26 and **26*a* secured thereto is moved or indexed to a doffing position where the partially assembled container is removed by a suitable means from the mandrel and conveyed away by suitable conveyor means to a finishing station. At the finishing station, the partially assembled container is grasped at the end thereof adjacent the dispensing head 26 or 26*a* by a suitable rotating head and is rotated thereby about the longitudinal axis of the tubular sidewall 22 during which rotation a quantity of a suitable adhesive is directed by means of suitable nozzle means onto the continuous juncture within the tubular sidewall 22 between the inner surface 52 thereof and the outer periphery of the dispensing head 26 and 26*a* to thereby form the continuous bead or fillet of adhesive 66 between the dispensing head and the tubular sidewall to provide a fluid tight seal therebetween. A suitable adhesive for the formation of the continuous bead or fillet 66** is a hot melt lutting designated as Finley No. 295-337.

The cartridge-type dispensing package or container 10 as described above has been designed to minimize costs associated with materials and assembly and with sufficient ruggedness to survive filling, closing, packing and shipping in suitable groups in shipping containers which are delivered to a food outlet where the cartridge-type dispensing packages are removed from the shipping containers as needed for reloading the dispensing guns. More rugged and more expensive construction can be utilized to adapt the instant cartridge-type dispensing containers for additional demands which could be placed upon them if they were to be distributed for individual handling and retail sale to private customers or individual restaurants. For example, the plug top closure 28 could be even more securely retained within the tubular sidewall 22 during shipping and handling by passing a length of tape from one side of the tubular sidewall transversely across the plug top closure 28 to the opposite side of the tubular sidewall. Such tape could be in the form of an elongated strip of paper or plastic sheet material having suitable adhesive on one side thereof adapted to securely engage the outer surface of the tubular sidewall. It will be understood that such tape would be removed from the container 10 prior to the positioning thereof within the dispensing gun 12. It will be further understood that a cartridge-type dispenser constructed in accordance with the present invention can be so constructed as to lend itself to repeated use involving cleaning and refilling. For example, the sidewall blank comprising the tubular sidewall 22 could be formed entirely of an extruded tube or a convolute sheet of plastic, for example a normally solid thermoplastic material such as polyethylene, polypropylene, mixtures thereof or the like, which would withstand repeated cleaning and refilling.

Changes may be made in the combination and arrangement of parts or elements as heretofore set forth in the specification and shown in the drawings without departing from the spirit and scope of the invention as defined and limited only by the following claims.

That which is claimed is:

1. A container comprising:

a generally cylindrically shaped tubular sidewall having an inner surface and first and second open ends, said first open end being formed in a radially inwardly rolled lip, and said second open end having an annular end face;

a generally flat circular disc disposed within said tubular sidewall in abutting relation with the radially inwardly rolled lip and having a generally cylindrical skirt on the outer periphery of said disc, said skirt terminating in a radially outwardly extending flange portion with a plurality of circumferentially spaced, radially outwardly extending bosses each extending between said flange portion and said generally cylindrical skirt, said skirt, said flange portion and said bosses being enfolded by the radially inwardly rolled lip of said generally cylindrically shaped tubular sidewall; and plug top closure means at least partially disposed within said tubular sidewall at the second open end thereof.

2. A container in accordance with claim 1 characterized further to include:

a plurality of slits through said circular disc and mutually intersecting at a point positioned generally in the said circular disc; and removable closure means releasably adhered to said circular disc over said plurality of slits therein for providing a fluid-tight closure of said slits.

3. A container in accordance with claim 1 wherein said plug top closure means is formed of a unitary homogeneous mass of synthetic resin material.

4. A container in accordance with claim 1 wherein said plug top closure means is formed of a unitary homogeneous mass of a normally solid thermoplastic material.

5. A container in accordance with claim 4 wherein said normally solid thermoplastic material comprises an alpha olefin polymer.

6. A container in accordance with claim 1 wherein said plug top closure means is formed of a unitary homogeneous mass of polyethylene.

7. A container in accordance with claim 1 wherein said generally flat circular disc is formed of a unitary homogeneous mass of synthetic resin material.

8. A container in accordance with claim 1 wherein said generally flat circular disc is formed of a sheet of synthetic resin material.

9. A container in accordance with claim 1 wherein said generally flat circular disc is formed of a unitary homogeneous mass of a normally solid thermoplastic material.

10. A container in accordance with claim 9 wherein said normally solid thermoplastic material comprises an alpha olefin polymer.

11. A container in accordance with claim 1 wherein said generally flat circular disc is formed of a unitary homogeneous mass of polyethylene.

12. A container in accordance with claim 1 wherein said generally cylindrically shaped tubular sidewall comprises:

a generally rectangular paperboard sidewall blank having first and second end faces and first and second side edges, said first side edge overlying said second side edge and being adhered to said second side edge by sidewall adhesive means.

13. A container in accordance with claim 12 wherein said sidewall adhesive means comprises a thermoplastic synthetic resin material.

14. A container in accordance with claim 12 wherein said paperboard sidewall blank is coated on at least one side thereof with a film of thermoplastic synthetic resin material.

15. A container in accordance with claim 14 wherein said film of thermoplastic synthetic resin material forms the inner surface of said tubular sidewall.

16. A container in accordance with claim 1 wherein said generally flat circular disc includes eight slits therethrough mutually intersecting at a point positioned generally in the center of said circular disc, each of said slits being generally straight and intersecting the next adjacent slit at an acute angle of about 45 degrees.

17. A container in accordance with claim 16 wherein said slits are of substantially equal length.

18. A container in accordance with claim 17 wherein each of said slits is about one half inch in length.

19. A container in accordance with claim 16 wherein each of said generally straight slits communicates at one end thereof with a pair of diverging slits through said circular disc, each said pair of diverging slits extending generally radially outwardly from the point of mutual intersection of said generally straight slits.

20. A container in accordance with claim 1 characterized further to include:

adhesive means disposed about the periphery of said circular disc and communicating between said circular disc and said tubular sidewall for securing said circular disc within said tubular sidewall in abutting relation with said inwardly rolled lip and providing a substantially fluid tight seal between said circular disc and said tubular sidewall.

21. A container in accordance with claim 1 or claim 20 wherein said plug top closure means is characterized further to include:

a generally cylindrical closure sidewall sized and shaped to be closely received within the open end of said tubular sidewall, said closure sidewall having radially outwardly extending closure flange means on a first end portion thereof adapted for yieldably abuttingly engaging the annular end face of said open end of said tubular sidewall, said closure sidewall further including at least one radially outwardly extending circumferential rib means on the generally cylindrical outer surface thereof, sized and shaped to tightly and slidingly engage the inner surface of said tubular sidewall so as to retain said plug top closure means within said tubular sidewall with said closure flange means in abutting engagement with the annular end face of said second open end of said tubular sidewall, and said plug top closure means further including generally radial end wall means extending across and closing a second end of said closure sidewall.

22. In a cartridge-type dispenser of the type which includes a generally cylindrical tubular body having first and second end portions with dispensing outlet means in the first end portion thereof and with the second end portion thereof being open and having an annular end face thereon, the improvement comprising:

plug closure means adapted to be at least partially disposed within the second end portion of said tubular body for closing said cartridge-type dispenser, said plug closure means having a generally cylindrical closure sidewall sized and shaped to be closely received within the second end portion of said tubular body and having radially outwardly extending closure flange means on a first end portion of said closure sidewall adapted for yieldably engaging said tubular body, said closure sidewall further including at least one radially outwardly extending circumferential rib means on the outer surface thereof adapted to tightly and slidingly engage the inner surface of said tubular body so as to at least temporarily retain said plug closure means within said second end portion of said tubular body, and means closing a second end of said generally cylindrical closure sidewall, said at least one radially outwardly extending circumferential rib means being interrupted at at least one location so as to provide means for venting gas therepast during insertion of said plug closure means in the second end portion of said tubular body.

23. A cartridge-type dispenser in accordance with claim 22 wherein said plug closure means is characterized further to include at least two of said radially outwardly extending circumferential rib means in longitudinally spaced relation on the outer surface of said generally cylindrical closure sidewall, at least one of said at least two rib means being interrupted at at least one location so as to provide means for venting gas therepast during insertion of said plug closure means in the second end portion of said tubular body.

24. A cartridge-type dispenser in accordance with claim 22 wherein said means closing a second end portion of said generally cylindrical closure sidewall is characterized further to include a generally radial end wall and a generally frustoconically shaped tapered transition portion communicating between said generally cylindrical closure sidewall and said generally radial end wall, said tapered transition portion providing means for facilitating the insertion of said plug closure means in the second end portion of said tubular body.

25. In a cartridge-type dispenser of the type which includes a generally cylindrical tubular body having first and second end portions with dispensing outlet means in the first end portion thereof and with the second end portion thereof being open and having an annular end face thereon, the improvement comprising:

plug closure means adapted to be at least partially disposed within the second end portion of said tubular body for closing said catridge-type dispenser, said plug closure means having a generally cylindrical closure sidewall sized and shaped to be closely received within the second end portion of said tubular body and having radially outwardly extending closure flange means on a first end portion of said closure sidewall adapted for yieldably engaging said tubular body, said closure sidewall further including at least two radially outwardly extending circumferential rib means in longitudinally spaced relation on the outer surface thereof adapted to tightly and slidingly engage the inner surface of said tubular body so as to at least temporarily retain said plug closure means within said second end portion of said tubular body, and means closing a second end of said generally cylindrical closure sidewall, the radially outwardly extending circumferential rib means nearest the second end of said generally cylindrical closure sidewall being interrupted at at least one location so as to provide means for venting air therepast during insertion of said plug closure means in the second end portion of said tubular body.

26. A cartridge-type dispenser in accordance with claim 25 wherein said means closing a second end portion of said generally cylindrical closure sidewall is characterized further to include a generally radial end wall and a generally frustoconically shaped tapered transition portion communicating between said generally cylindrical closure sidewall and said generally radial end wall, said tapered transition portion providing means for facilitating the insertion of said plug closure means in the second end portion of said tubular body.

27. A cartridge-type dispenser in accordance with claim 26 wherein said plug closure means is formed of a unitary homogeneous mass of normally solid thermoplastic material.

28. A cartridge-type dispenser in accordance with claim 27 wherein said normally solid thermoplastic material comprises an alpha olefin polymer.

29. A cartridge-type dispenser in accordance with claim 27 wherein said normally solid thermoplastic material is polyethylene.

* * * * *